US011492734B2

(12) United States Patent
Lonati et al.

(10) Patent No.: US 11,492,734 B2
(45) Date of Patent: Nov. 8, 2022

(54) METHOD FOR PROVIDING BLANKS FOR THE PRODUCTION OF INSHOES, FOOTLETS, NO-SHOW SOCKS, SHOES OF THE LIKE WITH DOUBLE LAYERS, WITH A CIRCULAR HOSIERY KNITTING MACHINE, AND INTERMEDIATE MANUFACTURE OBTAINED WITH THE METHOD

(71) Applicant: LONATI S.P.A., Brescia (IT)

(72) Inventors: Ettore Lonati, Botticino (IT); Fausto Lonati, Brescia (IT); Francesco Lonati, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 0 days.

(21) Appl. No.: 17/264,971

(22) PCT Filed: Mar. 18, 2019

(86) PCT No.: PCT/EP2019/056666
§ 371 (c)(1),
(2) Date: Feb. 1, 2021

(87) PCT Pub. No.: WO2020/025175
PCT Pub. Date: Feb. 6, 2020

(65) Prior Publication Data

US 2021/0324553 A1 Oct. 21, 2021

(30) Foreign Application Priority Data

Aug. 3, 2018 (IT) ..... 102018000007798

(51) Int. Cl.
*D04B 1/10* (2006.01)
*A43B 1/04* (2022.01)
(Continued)

(52) U.S. Cl.
CPC ..... *D04B 1/102* (2013.01); *A43B 1/04* (2013.01); *A43B 23/04* (2013.01); *D04B 1/26* (2013.01);
(Continued)

(58) Field of Classification Search
CPC ..... D04B 1/102; D04B 1/26; A43B 1/04
(Continued)

(56) References Cited

U.S. PATENT DOCUMENTS 271,338 A 1/1883 Lasher
2,987,900 A * 6/1961 Mahler ..... D04B 9/46 66/185
(Continued)

FOREIGN PATENT DOCUMENTS

AU 2002301335 A1 6/2003
CN 103582433 A 2/2014
(Continued)

OTHER PUBLICATIONS

Office Action issued for Chinese Patent Application No. 201980042000.9 dated Jan. 28, 2022, 12 pages.
(Continued)

*Primary Examiner* — Danny Worrell
(74) *Attorney, Agent, or Firm* — Husch Blackwell LLP

(57) ABSTRACT

A method for providing intermediate manufactures for production of manufactures such as an inshoe, footlet, no-show sock, shoes or the like with double thickness, with a circular hosiery knitting machine and an intermediate manufacture obtained with the method. The method has the particularity that it comprises at least the following steps:

a step of providing a first tubular portion of knitted fabric;

a casting-off step, in which a portion of knitted fabric is provided by moving to knit a group of contiguous needles at the at least one feed;

(Continued)

a casting-on step, in which a portion of knitted fabric is provided by moving to knit a group of contiguous needles at the at least one feed;

a step of providing a second tubular portion of knitted fabric by actuating the needle cylinder with a continuous rotary motion about its own axis in one direction of rotation.

17 Claims, 7 Drawing Sheets

(51) Int. Cl.
*A43B 23/04* (2006.01)
*D04B 1/26* (2006.01)

(52) U.S. Cl.
CPC .. *D10B 2403/023* (2013.01); *D10B 2501/043* (2013.01)

(58) Field of Classification Search
USPC ..... 66/30, 37
See application file for complete search history.

(56) References Cited

U.S. PATENT DOCUMENTS 5,103,656 A * 4/1992 Hanson, II ..... A41B 11/003 66/185
5,778,702 A * 7/1998 Wrightenberry ..... A41B 11/005 66/178 R
6,178,785 B1 1/2001 Samata
9,675,134 B2 * 6/2017 Kosui ..... A43B 23/042
10,316,441 B2 * 6/2019 Ly ..... D04B 1/123
10,499,701 B2 * 12/2019 Cai ..... D03D 15/54
10,631,594 B2 * 4/2020 Boucher ..... A43B 23/0225
10,745,834 B2 * 8/2020 Terai ..... A43B 23/0235
2003/0089136 A1 * 5/2003 Lynch ..... D04B 9/40 66/187
2012/0266362 A1 * 10/2012 Craig ..... D04B 1/26 66/185
2017/0311672 A1 11/2017 Hipp et al.
2018/0042340 A1 2/2018 Kuo et al.

FOREIGN PATENT DOCUMENTS

CN 106037119 A 10/2016
CN 106723658 A 5/2017
CN 107245800 A 10/2017
CN 207477042 U 6/2018
EP 2805638 A1 11/2014

OTHER PUBLICATIONS

Office Action issued for India Patent Application No. 202037050795 dated Jan. 27, 2022, 6 pages.
English Translation of Office Action issued for Russian Application No. 202092670 dated Oct. 14, 2021.
Search Report from corresponding IT patent application IT201800007798, dated Apr. 5, 2019.
Second Office Action issued for Chinese Patent Application No. 201980042000.9 dated Aug. 3, 2022, 17 pages.

* cited by examiner

METHOD FOR PROVIDING BLANKS FOR THE PRODUCTION OF INSHOES, FOOTLETS, NO-SHOW SOCKS, SHOES OF THE LIKE WITH DOUBLE LAYERS, WITH A CIRCULAR HOSIERY KNITTING MACHINE, AND INTERMEDIATE MANUFACTURE OBTAINED WITH THE METHOD

This application is a 371 of international application PCT/EP2019/056666 filed on Mar. 18, 2019 which is incorporated herein by reference.

The present invention relates to a method for providing intermediate manufactures for the production of manufactures such as an inshoe, footlet, no-show sock, shoes or the like with double thickness, with a circular hosiery knitting machine, and to an intermediate manufacture obtained with the method.

In the hosiery sector, products are known which are commonly termed insole, footlet, inshoe, minisock, no-show sock, et cetera, which substantially consist of manufactures provided to be worn on the feet, covering only the lower part of the foot or in any case the part below the ankle.

These manufactures are usually produced by using circular hosiery knitting machines in which the needle cylinder can be actuated with a rotary motion about its own axis in the two directions of rotation, moving to knit at at least one feed or drop of the machine only part of the needles of the machine and excluding from knitting the remaining needles during the production of a part of the manufacture or of all the manufacture.

Depending on the method used for their production, these products are unloaded from the production machine as finished manufactures, i.e., not requiring finishing operations to be marketed, or as intermediate manufactures, which must be subjected to further processes in order to give rise to the finished product.

Light shoes are also known in which the upper is made of a knitted fabric. In this case, the upper is usually constituted by multiple parts which are cut from a piece of knitted fabric and then assembled, generally by sewing, and applied to a sole.

The aim of the present invention is to devise a method that allows to produce intermediate manufactures for the production of manufactures of the type of an inshoe, footlet, no-show sock, shoes or the like with double thickness with a circular hosiery knitting machine.

Within this aim, an object of the invention is to provide a method that allows to produce intermediate manufactures that can be used for the production of light shoes with low production costs.

Another object of the invention is to devise a method that allows to provide intermediate manufactures that require a limited number of operations that are simple to perform in order to provide the finished product.

A further object of the invention is to provide a method for the production of intermediate manufactures that can be performed on circular hosiery knitting machines of the known type.

Another object of the invention is to also devise a method that allows to provide a finished manufacture that can be used as an inshoe, footlet, no-show sock or the like or as a light shoe.

This aim, as well as these and other objects which will become better apparent hereinafter, are achieved by a method for providing intermediate manufactures for the production of manufactures such as an inshoe, footlet, no-show sock, shoes or the like with double thickness, with a circular hosiery knitting machine with a needle cylinder arranged so that its axis is vertical, wherein said needle cylinder has, on its lateral surface, a plurality of axial slots, each of which accommodates a needle, at least one drop or feed being arranged around said needle cylinder and at least one yarn engageable by the needles to form knitting being dispensed thereat, means being provided for the actuation of the needles along the corresponding axial slot in order to grip the yarn at said at least one feed and form loops of knitting, selection devices being provided for selecting the needles to be moved to knit at said at least one feed, said needle cylinder being actuatable with a rotary motion about its own axis with respect to said at least one feed in both directions of rotation in order to form knitting by means of at least part of said needles with said at least one yarn dispensed by said at least one feed, characterized in that it comprises at least the following steps:

- a step for providing a first tubular portion of knitted fabric by actuating the needle cylinder with a continuous rotary motion about its own axis in one direction of rotation;
- a casting-off step, in which a portion of knitted fabric is provided by moving to knit a group of contiguous needles at said at least one feed, actuating the needle cylinder within an alternating rotary motion about its own axis and progressively decreasing the number of needles moved to knit at said at least one feed, excluding, according to a preset sequence, needles located at the lateral ends of said group of needles and retaining, by means of said needles excluded from knitting, the last formed loop of knitting, in order to form first partial rows of knitting;
- a casting-on step, in which a portion of knitted fabric is provided by moving to knit a group of contiguous needles at said at least one feed, actuating the needle cylinder with an alternating rotary motion about its own axis and progressively increasing the number of needles moved to knit at said at least one feed, returning to knit, according to a preset sequence which is the reverse of the sequence of said casting-off step, the needles previously excluded from knitting in said casting-off step, in order to provide second partial rows of knitting joined with said first partial rows of knitting;
- a step of providing a second tubular portion of knitted fabric by actuating the needle cylinder with a continuous rotary motion about its own axis in one direction of rotation;

in said casting-off step and in said casting-on step the respective preset sequences, according to which the number of needles of said group of needles moved to knit is first decreased and then increased, being such as to achieve the joining of said first tubular portion and of said second tubular portion with a lateral portion thereof at the loops of knitting, arranged at the ends of said first partial rows of knitting and of said second partial rows of knitting, formed by the needles previously excluded from knitting in said casting-off step and then returned to knit in said casting-on step, with the axes of said two tubular portions forming between them an angle that is substantially less than 90°.

Further characteristics and advantages of the invention will become better apparent from the description of a preferred but not exclusive embodiment of the method according to the invention and of a manufacture that can be obtained with the method, both illustrated by way of non-limiting example in the accompanying drawings, wherein.

The method according to the invention can be performed with a circular hosiery knitting machine of the known type, which comprises a needle cylinder, arranged so that its axis is vertical and provided, on its lateral surface, with a plurality of axial slots, inside each of which a needle is arranged. At least one drop or feed is arranged around the needle cylinder and at least one yarn is dispensed thereat which can be engaged by the needles to form knitting. The machine is provided with means for the actuation of the needles along the corresponding axial slot in order to grip the yarn at the above mentioned drop or feed and to form loops of knitting. Furthermore, the machine is provided with selection devices in order to select the needles to be moved to knit at the feed being considered. The needle cylinder can be actuated with a rotary motion about its own axis, with respect to the feed, in both directions of rotation in order to form knitting by means of at least part of the needles, using the at least one yarn dispensed by the feed.

Figure 3:
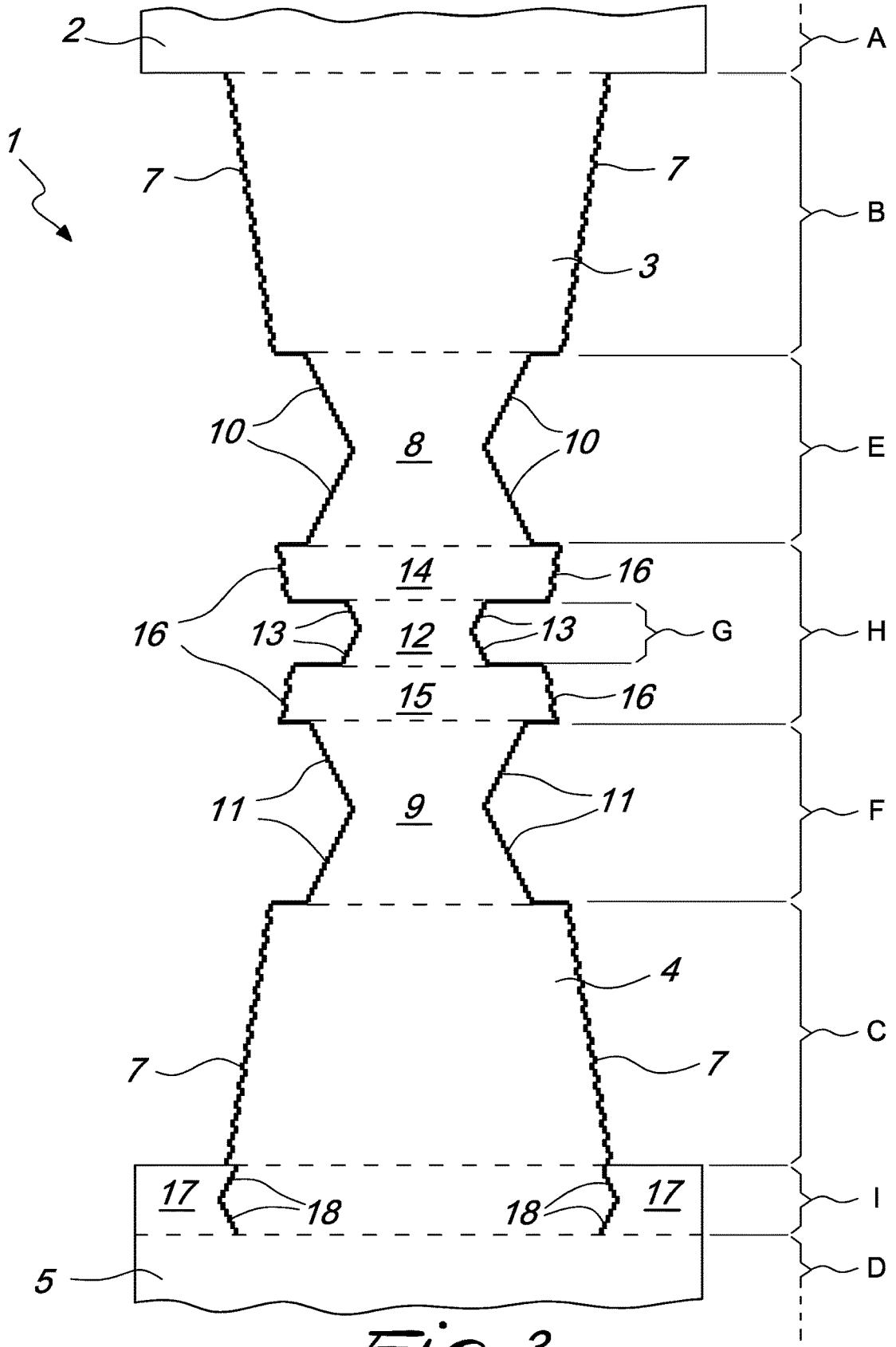
FIG. 3 is a diagram of execution of the method according to the invention in the production of an intermediate manufacture according to the invention.

With reference to FIG. 3, as will be described in greater detail hereinafter, the method according to the invention comprises at least:

a step A of providing a first tubular portion 2 of knitted fabric by actuating the needle cylinder with a continuous rotary motion about its own axis in one direction of rotation;

a casting-off step B, in which a portion 3 of knitted fabric is provided by moving to knit at the feed being considered a group of contiguous needles, actuating the needle cylinder within an alternating rotary motion about its own axis and progressively decreasing the number of needles moved to knit at the feed being considered, excluding, according to a preset sequence, needles located at the lateral ends of the group of needles and retaining, by means of the needles excluded from knitting, the last formed loop of knitting, in order to form first partial rows of knitting;

a casting-on step C, in which a portion 4 of knitted fabric is provided by moving to knit at the feed being considered a group of contiguous needles, actuating the needle cylinder with an alternating rotary motion about its own axis and progressively increasing the number of needles moved to knit at the feed being considered, returning to knit, according to a preset sequence which is the reverse of the sequence of the casting-off step B, the needles previously excluded from knitting during the casting-off step B, in order to provide second partial rows of knitting joined at their ends with the first partial rows of knitting formed in the casting-off step B;

a step D of providing a second tubular portion 5 of knitted fabric by actuating the needle cylinder with a continuous rotary motion about its own axis in one direction of rotation.

During the casting-off step B and during the casting-on step C, the respective preset sequences, according to which the number of needles of the group of needles moved to knit is first decreased and then increased, are such as to achieve, by means of the portions 3 and 4 of knitted fabric, the joining of the first tubular portion 2 and of the second tubular portion 5 with a lateral portion thereof at the loops of knitting, arranged at the ends of the first partial rows of knitting and of the second partial rows of knitting, formed by the needles previously excluded from knitting in the casting-off step B and then returned to knit in the casting-on step C, with the axes 2*a*, 5*a* of the two tubular portions 2, 5 forming between them an angle that is substantially less than 90°.

Figure 1:
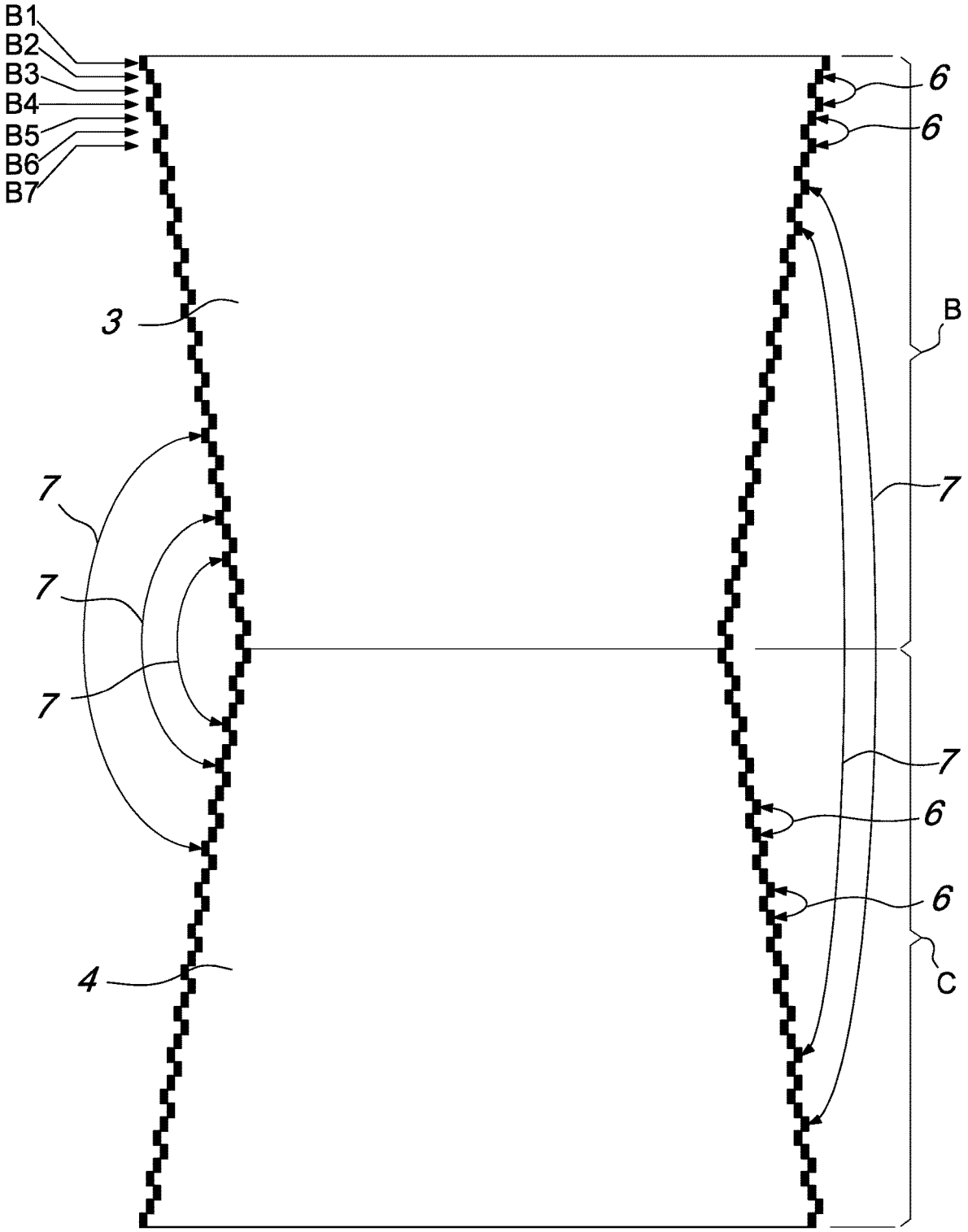
FIG. 1 is a diagram of the execution of a casting-off step followed by a casting-on step.

In order to better explain the execution of the casting-off step B and of the casting-on step C, FIG. 1 shows the knitting diagram of a piece of manufacture that is provided exclusively with a casting-off step B followed by a casting-on step C. Each black rectangle arranged vertically represents a needle and two rows of knitting (forward rotation and backward rotation). The needle casting-off sequence occurs therefore every two rows of knitting.

The casting-off of the needle or needles can be provided to occur:

— at the beginning of each row;

— at the end of each row;

— at the beginning and end of each row.

Figure 2:
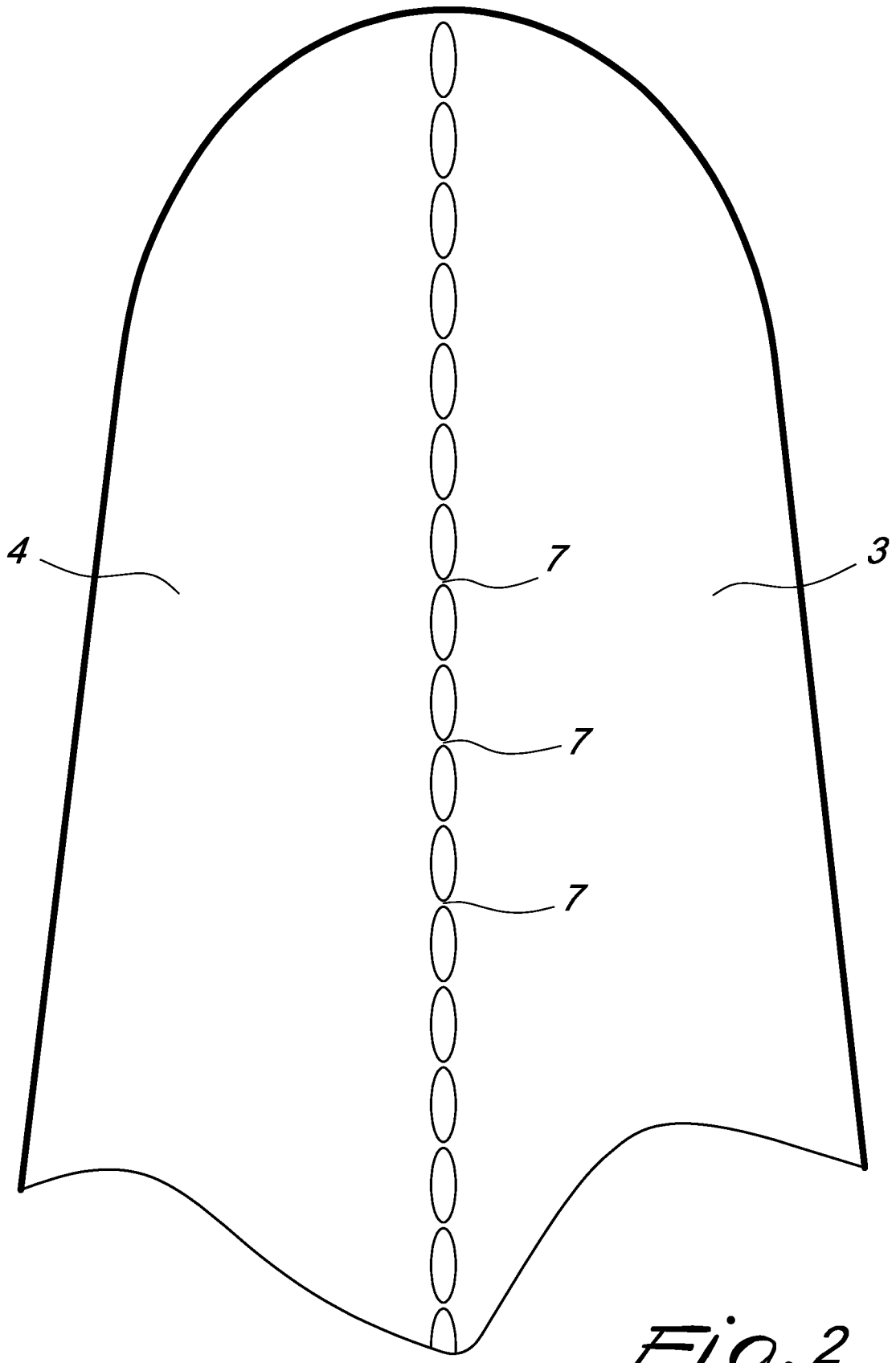
FIG. 2 is a schematic view of a manufacture portion obtained by following the knitting pattern shown in FIG. 1.

All the possibilities listed above can be embodied and are functional, and are differentiated only in the appearance of the fashioned knitting/eyelet (FIG. 2).

In FIG. 1, for the sake of simplicity, only the rectangles that correspond to the needles arranged at the ends of the group of contiguous needles moved to knit in these steps have been shown. The rectangles arranged on a same vertical line relate to a same needle.

As can be seen, during the casting-off step B, the number of needles that are moved to take the yarn or yarns (hereinafter, only "yarn" shall be mentioned, it being understood that the needles can also be fed with two or more yarns simultaneously, in a per se known manner, depending on the requirements) decreases progressively, as is evident from the inverted isosceles trapezoid shape of the portion of the diagram that corresponds to this step of knitting.

It should be noted that although in the casting-off step B, from the beginning (upper end of the pattern or longer parallel side of the inverted trapezoid) up to the end of this step (shorter parallel side of the inverted trapezoid), the number of needles moved to knit at the feed being considered decreases progressively, does not always decrease row by row, i.e., at each reversal of the rotation of the needle cylinder. In fact, as can be seen starting from the first upper row or longer parallel side of the trapezoid (forming of the first partial rows of knitting B1), in which the first needle is excluded at the beginning of each one of the two rows (forward rotation and backward rotation), when one moves on to form the second partial rows of knitting B2 (with reversal of the direction of rotation of the needle cylinder), the two needles located at the lateral ends of the group of needles used in the forming of the previous partial row of knitting B1 are excluded from knitting in addition to the needles excluded during the forming of the pair of rows B1. The same occurs when one moves on to form the third partial row of knitting B3. However, when one begins to form the fourth partial row of knitting B4 (new reversal of the direction of rotation of the needle cylinder about its own axis), the two needles that had been excluded from knitting during the forming of the third partial row of knitting B3 are returned to knit. In the forming of the fifth partial row of knitting B5 and in the forming of the sixth partial row of knitting B6, the two needles located at the lateral ends of the group of needles used to form the two preceding partial rows of knitting are again excluded from knitting. In the forming of the seventh partial row of knitting B7, the needles are subjected to casting-on, returning to knit the two needles that had been excluded in the forming of the sixth partial row of knitting B6, and so forth.

The pairs of rows can be in a different number with respect to the one of the example.

It should be noted that the return to knitting of a needle excluded from knitting during the forming of a previous partial row of knitting produces a tie between the loop of knitting formed the last time that the needle was moved to knit before it was excluded from knitting and the loop of knitting formed when the needle is returned to knit. In this manner, during the casting-off step B, so-called "intermediate ties" 6 are produced between the loops of knitting located at the lateral ends of the first partial rows of knitting.

During the casting-on step C, one proceeds by increasing progressively the number of needles that are moved to knit at the feed being considered, returning to knit the needles that progressively have been excluded from knitting during the casting-off step B, as is evident from the isosceles trapezoid shape of the portion of the diagram of FIG. 1 that corresponds to this step of the process.

The return to knitting of the needles previously excluded occurs by following a sequence that is the reverse of, but corresponds to, the sequence followed in the casting-off step B.

This means that from the beginning of the casting-on step C (shorter parallel side of the trapezoid) to the end of the casting-on step C (longer parallel side of the trapezoid), the needles that are moved to knit at the feed being considered increase as a whole, although every three partial rows of knitting two needles that had been returned to knitting during the forming of the directly preceding partial row of knitting, are excluded from knitting, following a sequence that is the reverse of the one followed during the casting-off step B. This sequence causes, even in the casting-on step C, intermediate ties 6 between the loops of knitting located at the lateral ends of the second partial rows of knitting.

The ends of the partial rows of knitting produced during the casting-off step B (oblique sides of the isosceles trapezoids, located on a same side, i.e., knitted by the same needles) are connected or rather tied to each other by means of so-called "closure ties" 7. The closure ties 7 and the intermediate ties 6 produce on the manufacture a row of stitches alternated with holes, which are shown schematically by means of ellipses in the drawings.

In practice, the progressive return to knitting, in the casting-on step C, of the needles previously excluded from knitting during the casting-off step B, provides a sort of knitting that resembles the so-called "heel knitting" that is typical of the heel and toe of hosiery.

However, the particular sequence followed during the casting-on step C and the casting-off step B causes the two portions 3 and 4 of the manufacture, produced in these steps, to be side by side and joined, but causes their axes (or central lines of the two portions 3 and 4) to form an angle that is substantially smaller than 90°, as can be seen in FIG. 2.

It should be noted that the measure of this angle can be changed according to the desired shape of the manufacture, by modifying the sequence of exclusion and return to knitting of the needles during the casting-off step B and the casting-on step C. In the schematic example of execution described above, during the casting-off step B the number of needles is reduced at each reversal of the direction of rotation of the needle cylinder for three partial rows and, in the casting-on step C, the number of active needles is increased correspondingly, but in the casting-off step B it is possible to reduce (and correspondingly increase, in the casting-on step C) the number of active needles every two or three reversals of the direction of rotation of the needle cylinder for a preset number of partial rows of knitting.

As already mentioned, FIG. 1 is only a schematic view of the casting-off step B and of the casting-on step C, in the hypothetical production of a manufacture only with these two steps merely to allow to understand how the two portions of manufacture 3 and 4 composed of the partial rows of knitting produced inside two steps B and C are tied to each other.

Actually, the method according to the invention comprises other steps. FIG. 3 shows the diagram of execution of the method according to the invention. Such diagram can be interpreted as the flat projection of an intermediate manufacture, generally designated by the reference numeral 1, obtained with the method according to the invention and ideally cut along horizontal lines, vertical lines and inclined lines, wherein:

- the vertical lines produce a longitudinal cross-section of the two tubular portions 2 and 5 of the manufacture;
- the horizontal lines produce a cross-section of the manufacture along a same row of knitting;
- the inclined lines produce cross-sections of the manufacture at the joining lines or at the fashioned knitting or ties in knitting of the so-called "heel" type or more generically with casting-off and subsequent casting-on. In the real manufacture, the inclined lines located on a same side of FIG. 3 and designated by the same numeral are joined and mutually superimposed, since they refer to loops of knitting formed by needles that are progressively excluded from knitting and are then progressively returned to knit, indeed producing the joining of the last loop of knitting formed before they were excluded from knitting with the first loop of knitting formed when they are returned to knit.

In this figure, the lines are formed by shaded rectangles which each corresponds to the actuation command of a needle at the feed being considered. For the sake of simplicity, only the rectangles that correspond to the lateral ends of the various regions that constitute the lines along which the manufacture has been ideally sectioned to provide FIG. 3 have been shown. The rectangles located along the same vertical ideal line relate to a same needle. As regards the casting-off step B and the casting-on step C, the same reference numerals already used in FIGS. 1 and 2 to identify said elements have been kept.

Figure 5:
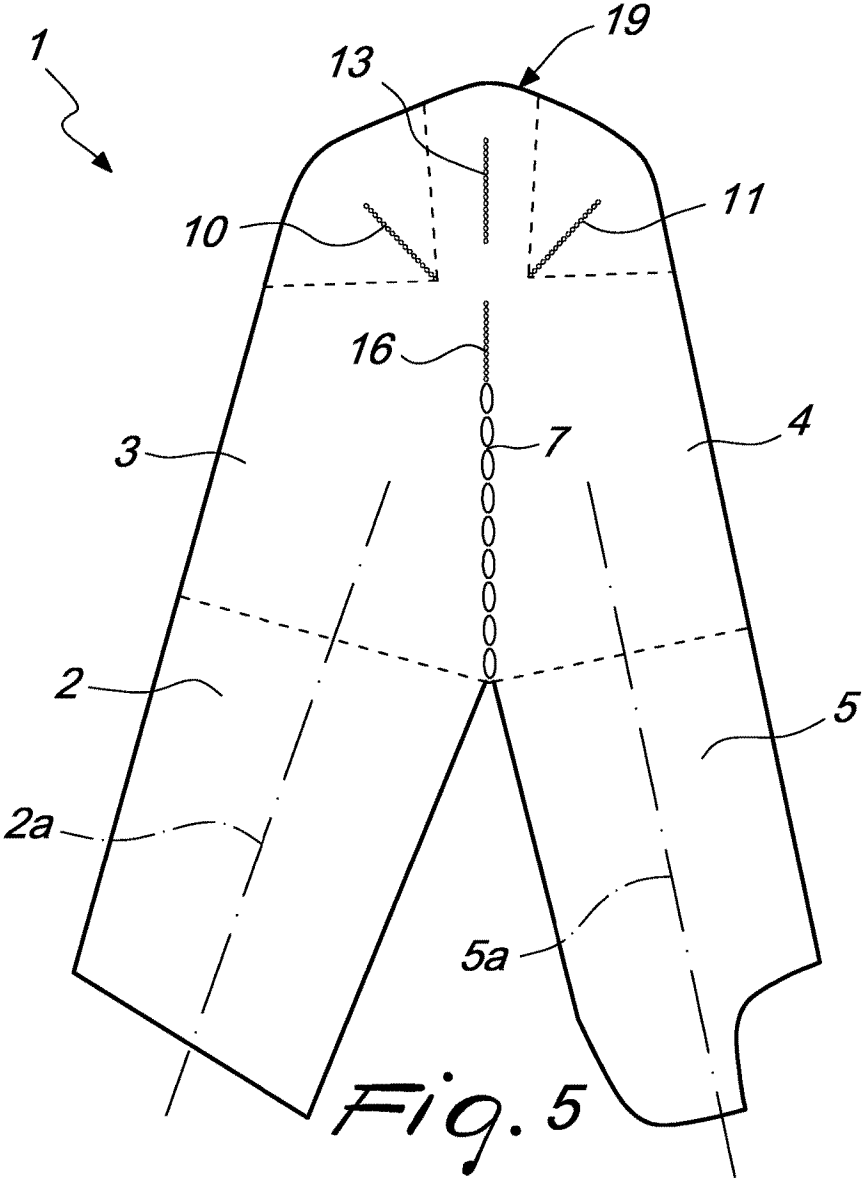
FIG. 5 is a schematic view of the same manufacture of FIG. 4, seen from the opposite side.
Figure 4:
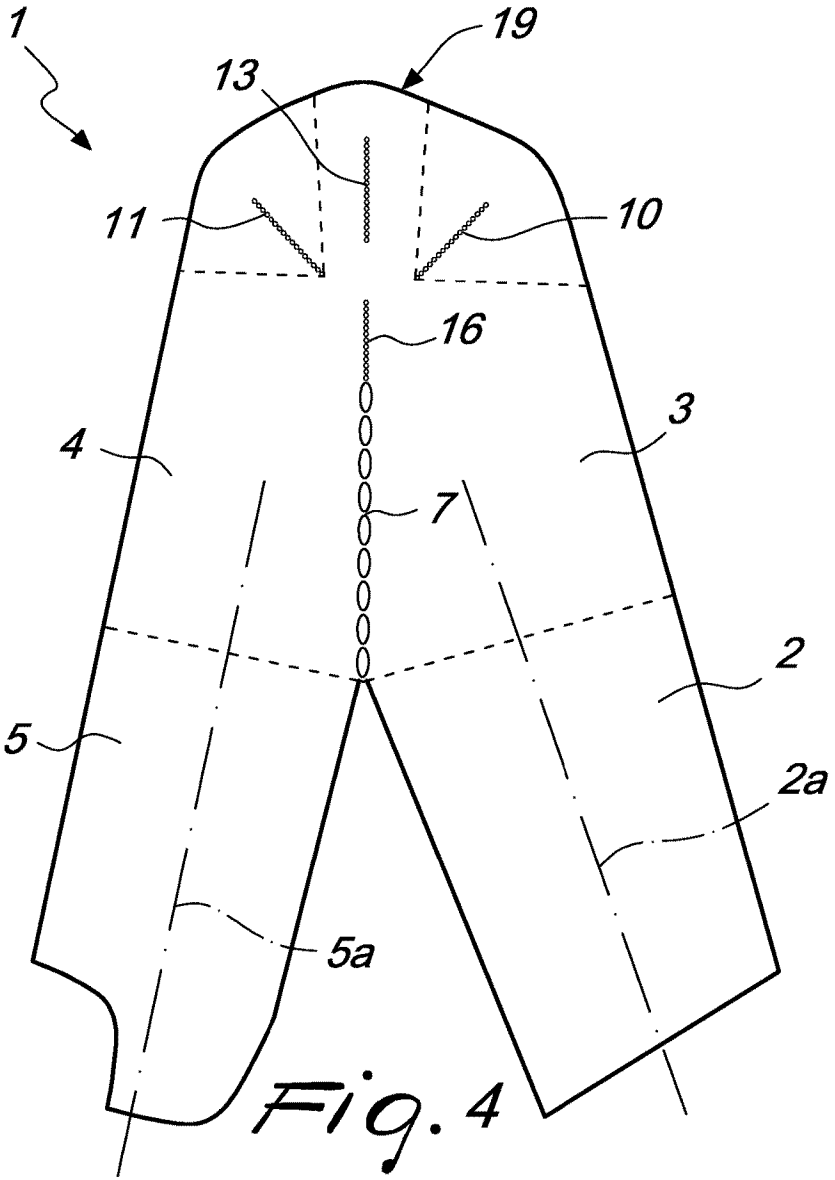
FIG. 4 is a schematic view of the manufacture that is obtained with the diagram of execution of the method shown in FIG. 3, arranged on a plane and seen from one side.

The intermediate manufacture 1 that is obtained with the method according to the invention is shown schematically in FIGS. 4 and 5. The lines and portions of the manufacture that in FIG. 3 correspond to the lines and portions of the manufacture of FIGS. 4 and 5 have been designated by the same reference numerals.

As mentioned above, the method according to the invention comprises a step A of execution of the first tubular portion 2 of knitted fabric.

This step is performed, in a per se known manner, by actuating the needle cylinder with a continuous rotary motion about its own axis with respect to the feed being considered.

This knitting is not described further, since it is entirely similar to the provision of the quarter or portion of the foot between the heel and the tip of a traditional hosiery item.

Then the casting-off step B is performed, as described above, providing a portion 3 of knitted fabric or of the manufacture being produced.

Before moving on to the execution of the casting-on step C, one part of the group of needles that has knitted during the casting-off step B performs at least two knitting processes E, F of the so-called "heel" type in sequence, providing two portions of manufacture that are designated by the reference numerals 8 and 9.

These two heel knitting processes E, F are performed in a per se known manner with a casting-off step followed by a casting-on step, so as to provide manufacture portions that are mutually joined by the so-called "fashioned knitting lines", designated by the reference numerals 10, 11. Essentially, in these "heel" knitting processes E, F, the needle cylinder is actuated with an alternating motion about its own axis, progressively reducing the number of active needles of a preset group of contiguous needles to then increase them progressively, returning to knit the needles previously excluded from knitting. The interruption and the resumption of knitting on the part of the needles that are located in each instance at the ends of the group of needles produce a line on the manufacture that is termed "fashioned knitting line" or "casting-off line" with stitches alternated with holes, as can be seen in FIGS. 4 to 12.

Preferably, between these two heel knitting processes E, F, one part of the group of needles used for the casting-off step B is actuated to perform a further heel knitting process G by means of the actuation of the needle cylinder with an alternating motion about its own axis.

This additional heel knitting process G, performed in a per se known manner, provides a portion of the manufacture that is designated by the reference digit 12 and is delimited by the fashioned knitting lines 13.

Directly before and directly after the provision of this further heel knitting process, a knitting process H is performed which constitutes a sort of continuation of the casting-off step B and an anticipation of the casting-on step C, which produces a shaped region of the manufacture 1 that affects two portions 14, 15 of the manufacture that are located between each of the two portions 8, 9 obtained with the two heel knitting processes E, F in sequence and the further heel knitting process G.

This shaped region has a joining line 16 of the portions 14, 15 of the manufacture which constitutes an extension of the closure ties 7 of the portions 3, 4 of the manufacture produced in the casting-off step B and in the casting-on step C.

The two heel knitting processes E, F and the further heel knitting process G are performed with a part of the needles used in the casting-off step B and in the casting-on step C.

Conveniently, since a symmetry is required in the region of the manufacture that is performed in the casting-off step B and in the casting-on step C, as well as in the step for providing the two heel knitting processes E, F in sequence and in the further heel knitting process G, the parts of the group of needles used for the two heel knitting processes E, F and for the further heel knitting process G are located centrally with respect to the group of needles used for the casting-off step B and for the casting-on step C.

The second tubular portion 5 is also performed in a per se known manner, as if it were the foot of a hosiery item.

Conveniently, the second tubular portion 5 can be ended, in a per se known manner, with a hosiery toe knitting ready to be sewn or looped. Preferably, the sewing or looping line for closing the toe of the second tubular portion 5 in the finished manufacture is located under the toes of the user.

Conveniently, prior to the execution of the second tubular portion 5, a group of needles that do not belong to the group of needles used to execute the casting-off step B and the casting-on step C, but is indeed arranged opposite thereto in the needle cylinder, can be used to perform another heel knitting process I, providing a portion 17 that is delimited by the dropped knitting lines 18.

As can be seen in FIGS. 4 and 5, the intermediate manufacture 1, at the outlet of the machine, appears substantially identical on its two sides. As can be noted, the manufacture 1 is constituted substantially by the two tubular portions 2 and 5, which are joined by means of a lateral portion thereof and by means of a contoured portion 19, which is located at one end of the manufacture and is provided by means of one or more heel knitting processes, in which the axes 2*a* and 5*a* of the two tubular portions 2 and 5 form between them an angle substantially smaller than 90°.

Once the manufacture 1 has been unloaded from the production machine, it is subjected to a series of operations in order to produce a finished product.

Figure 6:
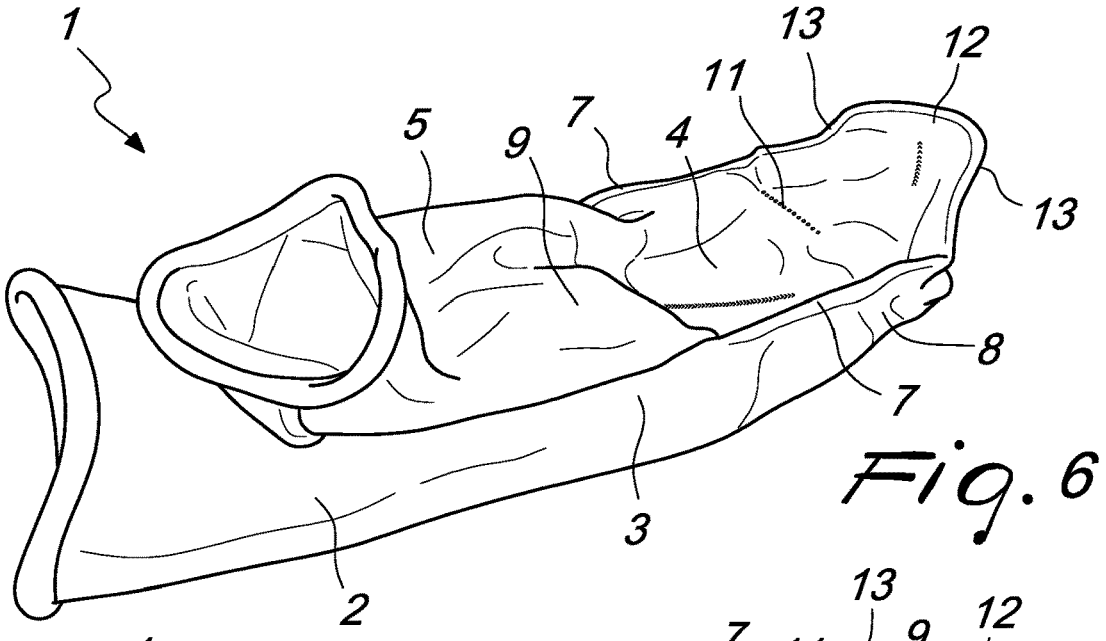
FIGS. 6 to 8 are perspective views of the insertion and inward folding of a part of the manufacture, obtained with the method, within the remaining part.
Figure 7:
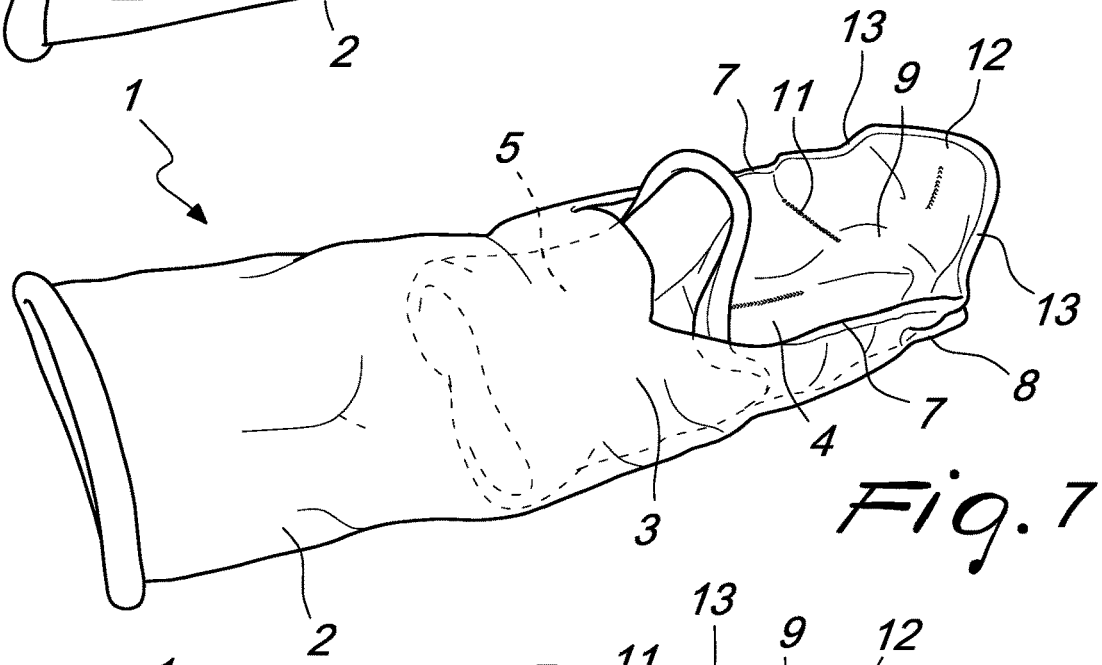
Figure 8:
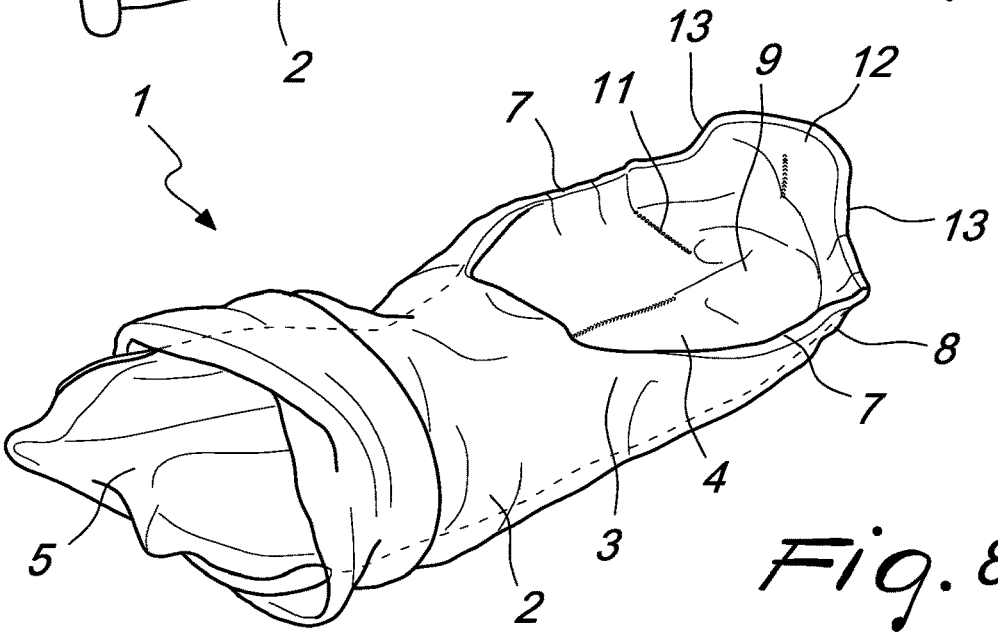
Figure 9:
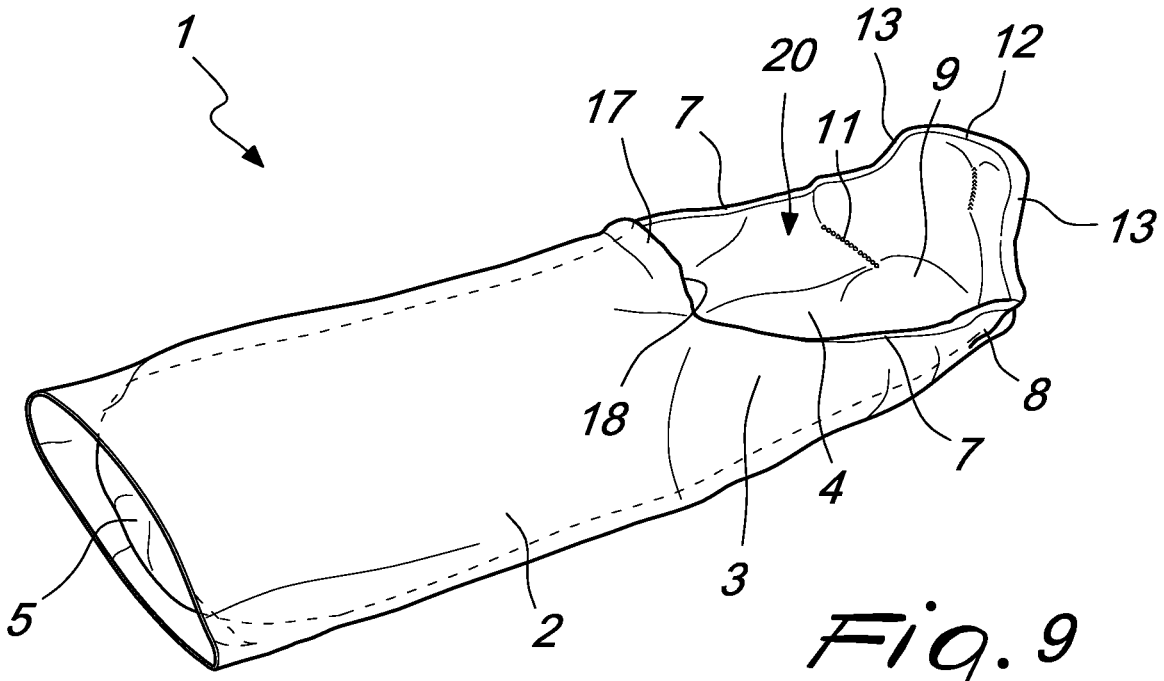
FIG. 9 is a perspective view of the manufacture that is obtained at the end of the insertion and inward folding shown in FIGS. 6 to 8.
Figure 10:
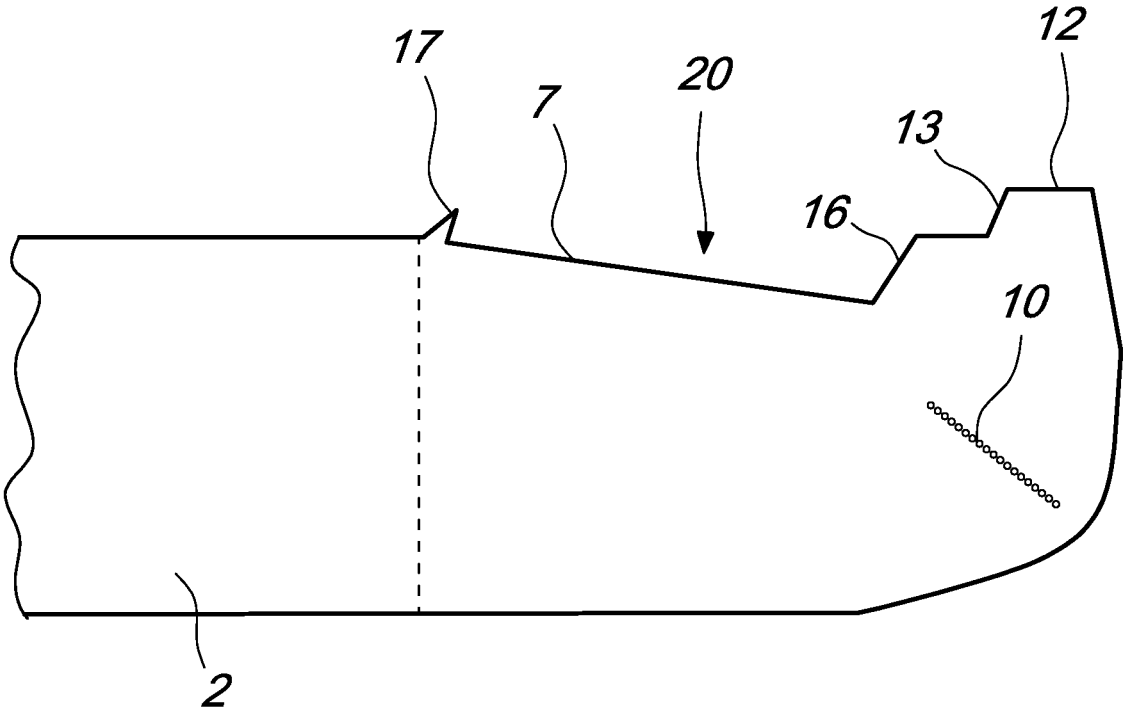
FIG. 10 is a lateral elevation view of a portion of the manufacture of FIG. 9.
Figure 11:
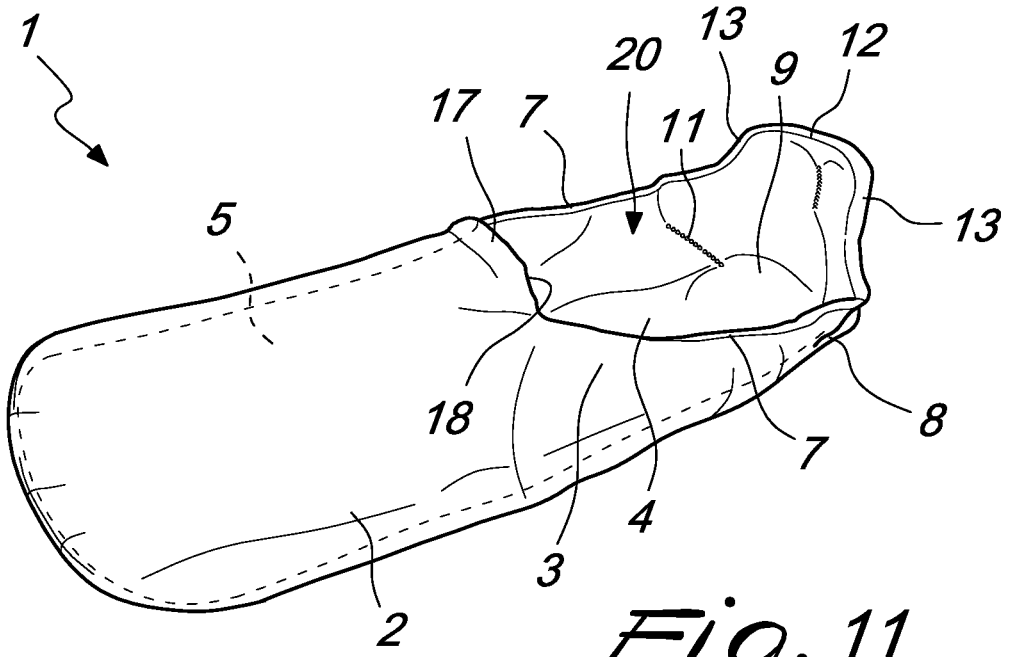
FIG. 11 is a perspective view of an inshoe that can be obtained with the manufacture provided with the method according to the invention.
Figure 12:
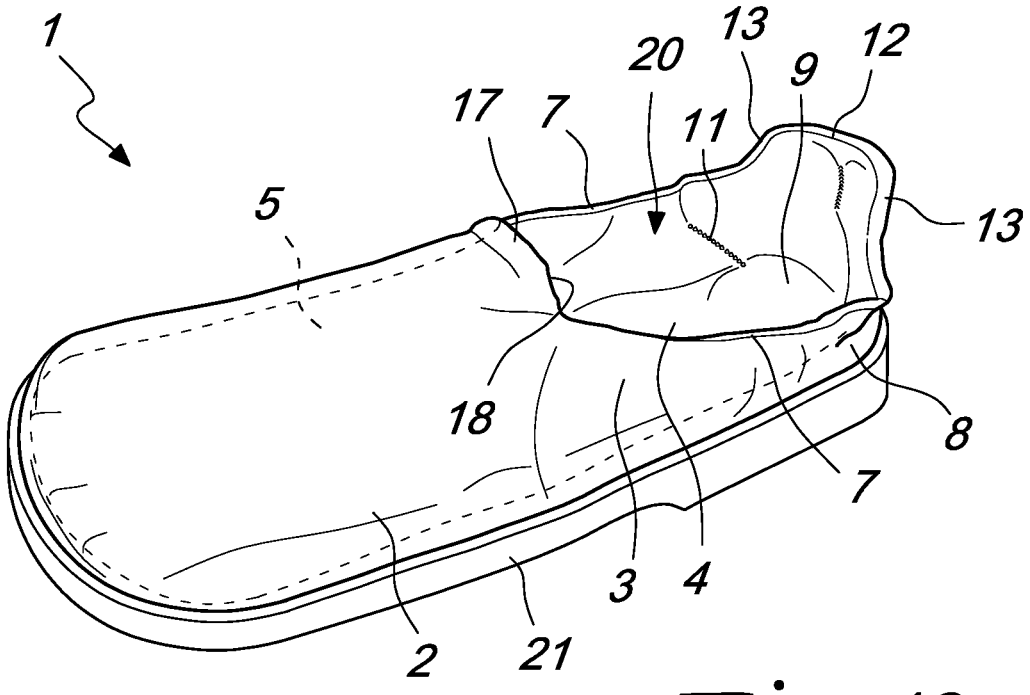
FIG. 12 is a perspective view of a light shoe that can be obtained with the manufacture provided with the method according to the invention.

More particularly, as shown in FIG. 6, the portion 4 of the manufacture 1 that is provided during the casting-on step C is pushed inside the portion 3 of the manufacture produced during the casting-off step B by folding the manufacture 1 along the joining lines, i.e., the closure ties 7, of these two portions 3, 4 of the manufacture 1. The portion 9 provided with one of the heel knitting processes F also is pushed against the inside of the other portion 8 provided with the other one of the heel knitting processes E and by folding the portion 12 provided with the further heel knitting process G at the centerline so as to constitute a sort of rear tongue.

The second tubular portion 5 is then folded inward inside the first tubular portion 2 so as to obtain a sort of shoe or sock with double thickness in which the joining lines, i.e., the closure ties 7, of the portion 3 of the manufacture produced in the casting-off step B with the portion 4 of the manufacture produced in the casting-on step C delimit laterally a foot insertion opening 20 of the shoe or sock with double thickness.

More particularly, the first tubular portion 2 is located externally, and likewise the portion 8 connected thereto, provided with the heel knitting process E, is also located externally. The other portion 9 provided with the other heel knitting process F is located inside and is superimposed on the portion 8. The portion 12 straddles, i.e., is extended partly externally and partly internally, mutually connecting the portions 8 and 9. The portions 3, 4 provided in the casting-off step B and in the casting-on step C are located respectively outside and inside the region in which the foot insertion opening 20 is formed and constitute the lateral and lower regions with respect to said foot insertion opening 20. If a particular large extension of these regions is desired, with circular hosiery knitting machines of the known type in which the selection of the needles to be moved to knit during the rotary motion of the needle cylinder in one direction is performed during the directly preceding motion in the opposite direction, it is possible to use a method of the type described in patent application 102018000002290, in the name of the same Applicant, which has not yet been published.

The portion 17 provided with the heel knitting process I, by means of needles that belong to a group of needles that is opposite with respect to the group of needles used in the casting-off step B and in the casting-on step C also extends partly inside and partly outside the hosiery item or shoe, constituting a front tongue.

Advantageously, between the internal part and the external part of the hosiery item or shoe thus obtained or in the yarn used for its production it is possible to provide an adhesive, for example an adhesive that can be reactivated by heat, in order to stably mutually connect the two parts, the inner one and the outer one, that constitute the hosiery item or shoe.

The hosiery item or shoe is completed by closing, in a per se known manner, the toe, i.e., the free end of the second tubular portion 5 and by cutting and closing, for example by sewing or other known method, the free end of the first tubular portion 2.

If the manufacture is intended to produce a shoe, on the lower side, i.e., on the side of the manufacture that is opposite with respect to the foot insertion opening 20, it is possible to apply, for example by adhesive bonding or molding, a sole 21. In this case, the operation for closing the free end of the first tubular portion 2 can be integrated with the operation of application of the sole 21.

In practice it has been found that the method according to the invention fully achieves the intended aim, since it allows to provide intermediate manufactures for the production of manufactures such as an inshoe, footlet, no-show sock or the like with double thickness with a circular hosiery knitting machine, reducing the number and therefore the cost of the operations required to achieve the finished product.

A further advantage of the method according to the invention is that it can be used to produce intermediate manufactures that can be used to produce light shoes at low costs.

The method and the intermediate manufacture that can be obtained therewith, thus conceived, are susceptible of numerous modifications and variations, all of which are within the scope of the appended claims; all the details may furthermore be replaced with other technically equivalent elements.

In practice, the materials used, as well as the dimensions, may be any according to the requirements and the state of the art.

The disclosures in Italian Patent Application No. 102018000007798 from which this application claims priority are incorporated herein by reference.

The invention claimed is:

1. A method for providing intermediate manufactures for the production of clothing items with double layers, with a circular hosiery knitting machine with a needle cylinder arranged so that an axis thereof is vertical, wherein said needle cylinder has, on its lateral surface, a plurality of axial slots, each of which accommodates a needle, at least one drop or feed being arranged around said needle cylinder and at least one yarn engageable by the needles to form knitting being dispensed thereat, means being provided for the actuation of the needles along the corresponding axial slot in order to grip the yarn at said at least one feed and form loops of knitting, selection devices being provided for selecting the needles to be moved to knit at said at least one feed, said needle cylinder being actuatable with a rotary motion about its own axis with respect to said at least one feed in both directions of rotation in order to form knitting by means of at least part of said needles with said at least one yarn dispensed by said at least one feed, further comprising at least the following steps:

a step of providing a first tubular portion of knitted fabric by actuating the needle cylinder with a continuous rotary motion about its own axis in one direction of rotation;

a casting-off step, in which a portion of knitted fabric is provided by moving to knit a group of contiguous needles at said at least one feed, actuating the needle cylinder within an alternating rotary motion about its own axis and progressively decreasing the number of needles moved to knit at said at least one feed, excluding, according to a preset sequence, needles located at the lateral ends of said group of needles and retaining, by means of said needles excluded from knitting, the last formed loop of knitting, in order to form first partial rows of knitting;

a casting-on step, in which a portion of knitted fabric is provided by moving to knit a group of contiguous needles at said at least one feed, actuating the needle cylinder with an alternating rotary motion about its own axis and progressively increasing the number of needles moved to knit at said at least one feed, returning to knit, according to a preset sequence which is the reverse of the sequence of said casting-off step, the needles previously excluded from knitting in said casting-off step, in order to provide second partial rows of knitting joined with said first partial rows of knitting;

a step of providing a second tubular portion of knitted fabric by actuating the needle cylinder with a continuous rotary motion about its own axis in one direction of rotation;

in said casting-off step and in said casting-on step the respective preset sequences, according to which the number of needles of said group of needles moved to knit is first decreased and then increased, being to achieve the joining of said first tubular portion and of said second tubular portion with a lateral portion thereof at the loops of knitting, arranged at the ends of said first partial rows of knitting and of said second partial rows of knitting, formed by the needles previously excluded from knitting in said casting-off step and then returned to knit in said casting-on step, with the axes of said two tubular portions forming between them an angle that is less than 90°.

2. The method according to claim 1, wherein in said casting-off step, despite reducing as a whole the number of needles moved to knit at said at least one feed, in the execution of some partial rows of knitting, needles excluded from knitting in the execution of previous partial rows of knitting are returned to knit.

3. The method according to claim 1, wherein in said casting-on step, despite increasing as a whole the number of needles moved to knit at said at least one feed, in the execution of some partial rows of knitting, needles returned to knit in the execution of previous partial rows of knitting are excluded from knitting.

4. The method according to claim 1, wherein after said casting-off step and before said casting-on step, a part of said group of needles performs at least two heel knitting processes in sequence by means of the actuation with an alternating rotary motion of the needle cylinder about its own axis.

5. The method according to claim 4, wherein between said two heel knitting processes in sequence, a part of said group of needles is actuated to perform a further heel knitting process by means of the actuation with an alternating rotary motion of the needle cylinder about its own axis.

6. The method according to claim 4, wherein the part of needles of said group of needles that performs said two heel knitting processes in sequence is arranged centrally within said group of needles.

7. The method according to claim 5, wherein the part of needles of said group of needles that performs said further heel knitting process is arranged centrally within said group of needles.

8. The method according to claim 1, wherein said second tubular portion of knitted fabric is ended with sock toe knitting.

9. The method according to claim 1, wherein the portion of the manufacture that is provided during the casting-on step is pushed inside the portion of the manufacture provided during the casting-off step by folding the manufacture along closure ties of said two portions of the manufacture provided during the casting-on and the casting-off steps, and wherein said second tubular portion is folded inward inside said first tubular portion; one portion of the two portions obtained with one of the two heel knitting processes in sequence, closest to the portion of manufacture provided during the casting-on step, being pushed against the inner side of the other portion obtained with the other one of the two heel knitting processes in sequence, obtaining a sort of shoe or sock with double layers in which the closure ties that connect the portion of the manufacture produced in the casting-off step with the portion of the manufacture produced in the casting-on step delimit laterally a foot insertion opening for putting on the shoe or sock with double layers.

10. The method according to claim 5, wherein a manufacture portion provided by means of said further heel knitting process provides a rear tongue which connects to each other portions of the manufacture provided by means of said two heel knitting processes.

11. A method for producing clothing items with double layers, comprising the steps of providing an intermediate manufacture by means of a method according to claim 1 and closing free ends of said two tubular portions.

12. The method according to claim 11, wherein a sole is applied to a side of said first tubular portion that is opposite to a foot insertion opening.

13. The method according to claim 11, wherein a part of the manufacture that is arranged externally and a part of the manufacture that is arranged internally are glued together.

14. An intermediate manufacture for the production of clothing items with double layers, obtained through the method according to claim 1, the intermediate manufacture comprising a first tubular portion and a second tubular portion which are joined by means of a lateral portion thereof and by means of a contoured portion provided with at least one heel knitting process, axes of said two tubular portions forming between them an angle that is less than 90°.

15. The intermediate manufacture according to claim 14, wherein a part of the second tubular portion is arranged inside a part of the first tubular portion at a region of lateral joining of the two tubular portions, and wherein said second tubular portion is folded inward inside said first tubular portion, forming a sort of shoe or sock with double layers, with a joining region of the two tubular portions which forms a foot insertion opening for the shoe or sock with double layers.

16. A clothing item with double layers, comprising an intermediate item according to claim 14, wherein axial ends of said tubular portions which are opposite to axial ends that are mutually joined by means of said contoured portion are closed.

17. The manufacture according to claim 16, wherein a sole is applied at the side of said first tubular portion that is opposite to the side in which said foot insertion opening is provided.

* * * * *